US008689700B2

(12) United States Patent
Hoeschen

(10) Patent No.: US 8,689,700 B2
(45) Date of Patent: Apr. 8, 2014

(54) DEVICE FOR HANDLING BANKNOTES WITH A VIRTUAL AUXILIARY CASSETTE FOR EXCHANGING PARTIAL FUNDS CASSETTE

(75) Inventor: Hermann Hoeschen, Paderborn (DE)

(73) Assignee: Wincor Nixdorf International GmbH (DE)

( * ) Notice: Subject to any disclaimer, the term of this patent is extended or adjusted under 35 U.S.C. 154(b) by 0 days.

(21) Appl. No.: 13/825,951

(22) PCT Filed: Aug. 13, 2012

(86) PCT No.: PCT/EP2012/065796

§ 371 (c)(1), (2), (4) Date: Mar. 25, 2013

(87) PCT Pub. No.: WO2013/034398

PCT Pub. Date: Mar. 14, 2013

(65) Prior Publication Data

US 2013/0199888 A1 Aug. 8, 2013

(30) Foreign Application Priority Data

Sep. 9, 2011 (DE) ..... 10 2011 053 442

(51) Int. Cl.
*G07F 7/04* (2006.01)

(52) U.S. Cl.
USPC ..... 104/206

(58) Field of Classification Search
USPC ..... 194/200, 206; 209/534; 235/379; 902/11; 700/215, 224, 225, 226; 705/39, 40, 42, 43, 45
See application file for complete search history.

(56) References Cited

U.S. PATENT DOCUMENTS

| | | | | |
|---|---|---|---|---|
| 4,775,783 | A | 10/1988 | Sasaki et al. | |
| 6,128,550 | A | 10/2000 | Heidel et al. | |
| 7,252,185 | B2 * | 8/2007 | Fujita et al. | 194/350 |
| 2005/0173515 | A1 | 8/2005 | Sawa | |

FOREIGN PATENT DOCUMENTS

| | | | |
|---|---|---|---|
| DE | 3909637 | A1 | 10/1989 |
| DE | 10-2007-014176 | A1 | 8/2008 |
| DE | 10-2010-004580 | A1 | 7/2011 |
| EP | 2154655 | A1 | 2/2010 |

OTHER PUBLICATIONS

International Search Report and Written Opinion (Both in German and English) for PCT/EP2012/065796, mailed Nov. 6, 2012; ISA/EP.

* cited by examiner

*Primary Examiner* — Mark Beauchaine
(74) *Attorney, Agent, or Firm* — Harness, Dickey & Pierce, P.L.C.

(57) ABSTRACT

The invention relates to a device for handling banknotes comprising an input and output unit, a control unit, at least one money cassette, a reject cassette and a transport unit to transport the banknotes. In addition, a stock counter is provided that indicates the current quantity of banknotes in the money cassette. When an incorrect withdrawal occurs after at least one banknote is removed from the money cassette, the banknotes from this incorrect withdrawal are transported to the reject cassette. A reject counter is assigned to the money cassette that indicates the total number of banknotes removed from said money cassette and taken to the reject cassette, wherein the value of said reject counter is increased by the value of the banknotes transported to the reject cassette when the incorrect withdrawal occurs. A virtual auxiliary cassette is set up in the software of the control unit.

14 Claims, 5 Drawing Sheets

50

| | 22 Money Cassette for 5s | 24 Money Cassette for 10s | 26 Money Cassette for 20s | 28 Additional Money Cassette | Virtual Auxiliary Cassette (70) |
|---|---|---|---|---|---|
| Number of Banknotes in Money Cassette | K | L | M | N | 0 (72) |
| Number of Banknotes from this Money Cassette in Reject Cassette | 0 | 0 | 0 | 0 | |
| | 52 62 | 54 64 | 56 66 | 58 68 | |

FIG. 4

50

| | 22 Money Cassette for 5s | 24 Money Cassette for 10s | 26 Money Cassette for 20s | 28 Additional Money Cassette | Virtual Auxiliary Cassette (70) |
|---|---|---|---|---|---|
| Number of Banknotes in Money Cassette | K | L | M - 2 | N | 0 (72) |
| Number of Banknotes from this Money Cassette in Reject Cassette | 0 | 0 | + 2 | 0 | |
| | 52 62 | 54 64 | 56 66 | 58 68 | |

FIG. 5

50

| | Money Cassette for 5s (74) | Money Cassette for 10s (24) | Money Cassette for 20s (76) | Additional Money Cassette (28) | Virtual Auxiliary Cassette (70) |
|---|---|---|---|---|---|
| Number of Banknotes in Money Cassette | S (78) | L (54) | T (80) | N (58) | + 2 (72) |
| Number of Banknotes from this Money Cassette in Reject Cassette | 0 (82) | 0 (64) | 0 (84) | 0 (68) | |

FIG. 6

DEVICE FOR HANDLING BANKNOTES WITH A VIRTUAL AUXILIARY CASSETTE FOR EXCHANGING PARTIAL FUNDS CASSETTE

CROSS-REFERENCE TO RELATED APPLICATIONS

This application is a National Stage of International Application No. PCT/EP2012/065796, filed Aug. 13, 2012, and published in German as WO 2013/034398 A1 on Mar. 14, 2013. This application claims the benefit and priority of German Application No. 10 2011 053 442.3, filed Sep. 9, 2011. The entire disclosures of the above applications are incorporated herein by reference.

BACKGROUND

This section provides background information related to the present disclosure which is not necessarily prior art.

TECHNICAL FIELD

The device relates to a device for handling banknotes that comprises an input and output unit for depositing and disbursing banknotes, a control unit, at least one money cassette to store banknotes and a reject cassette for receiving banknotes to be retained. The device further has a transport unit with the aid of which the banknotes can be transported between the input and output unit, the money cassette and the reject cassette. Furthermore, a stock counter is provided that indicates the current quantity of banknotes in the money cassette. The control unit reduces the value of the counter by the value of 1 when a banknote is removed from the money cassette and increases the value of the counter by the value of 1 when a banknote is taken to the money cassette. If an incorrect withdrawal occurs after removing a banknote from the money cassette, the control unit activates the transport unit in such fashion that said transport unit transports the banknote, or banknotes, from the incorrect withdrawal to the reject cassette. Further, a money-cassette specific reject counter explicitly assigned to the money cassette is provided that indicates the total number of banknotes removed from this money cassette and taken to the reject cassette. When an incorrect withdrawal occurs, the control unit increases the value of this reject counter by the number of banknotes taken from this money cassette because of the incorrect withdrawal and transported to the reject cassette. The invention further relates to a method for operating such a device for handling banknotes.

DISCUSSION

The device for handling banknotes is specifically an automated teller safe, an automated cash register system and/or an automated teller machine. The stock and reject counters described previously are provided specifically to be able to determine the current quantity of banknotes in the device at any time. Because of the software standards for the software used in the device, specifically the Extension for Financial Services (XFS) applications or Java Extension for Financial Services (JXFS) applications used, the reject cassette does not have its own stock counter. In order to be able to determine the current quantity of all banknotes in the device, a reject counter is assigned to each money cassette in which, as described previously, if an incorrect withdrawal occurs, the banknotes that were transported to the reject cassette on account of this incorrect withdrawal, are posted so that, without the provision of a separate stock counter for the reject cassette, its quantity can be determined by totaling the reject counters of all money cassettes in the device. This type of stock monitoring of banknotes in the device is particularly problematic when partially exchanging money cassettes in the money cassettes in the device. Partial exchange of money cassettes for the money cassettes in the device is when not all the money cassettes housed in the device but only some of these money cassettes are removed. As a result of removing the money cassettes, the stock and reject counters for the money cassettes are "lost," so that the quantity in the reject cassettes remaining in the device can no longer be determined simply by totaling the reject counters of the money cassette. One possibility for circumventing this problem is simply to exchange all the money cassettes, including the reject cassette, at the same time. However, this has the disadvantage that money cassettes have to be exchanged that would not actually have to be exchanged at the time so that unnecessary expense results.

An additional method is to assign the value of the reject counter of the money cassette removed to the reject counter of the money cassette newly installed in place of said removed money cassette. The problem with this procedure is that this procedure only yields a correct result if banknotes of the same denomination as in the money cassette removed are recorded in the newly installed money cassette. Otherwise multiplying the banknote quantity of the money cassette with the assigned denomination results in a differing value so that the total quantity, i.e. the value of the banknotes accepted in the device is incorrectly calculated. Furthermore, this procedure works correctly only if a new money cassette is actually installed. If the receiving area from which the money cassette is removed remains empty on the other hand, it is not possible, because of the existing application structure of the software in the money cassette, to save the value of the reject counter of the money cassette that was removed so that the quantity in the reject cassette can no longer be determined in this instance.

SUMMARY OF THE INVENTION

It is an object of the invention to cite a device for handling banknotes and a method for operating a device for handling banknotes with the aid of which, in spite of a money cassette being removed from the device and retaining the reject cassette, the quantity in the device can easily be determined.

In accordance with the invention, a virtual auxiliary cassette is set up in the software of the control unit. A stock counter is assigned to this virtual cassette, as it is to the physically existing money cassettes. When a money cassette is removed from the device, the control unit increases the value of the stock counter of the virtual auxiliary cassette by the value of the reject counter of the money cassette that was removed. The result is that the value of the reject counter is not "lost" due to the removal of the money cassette and, thus, even if only the money cassette is removed without changing the reject cassette, the quantity of banknotes in the device can be determined in the same way as before the removal of the money cassette. Specifically, the same applications stored in the software can be used to determine the quantity of banknotes in the device that are stored anyway in the control unit. This virtual auxiliary cassette to which the value of the reject counter of a money cassette is assigned each time when said money cassette is removed makes it possible for a money cassette of the same denomination, a money cassette of a differing denomination, or even no new money cassette to be inserted in place of the money cassette that was removed, and the total quantity of banknotes in the device can nevertheless be determined easily and without error each time. In this way, a partial exchange of cassettes can be made without changes to the software in the control unit of the device.

An incorrect withdrawal is generally understood to mean that a double withdrawal, a multiple withdrawal and/or a banknote jam has occurred. In order that a wrong sum of money is not paid out to the person operating the device, the banknotes in the double withdrawal, the multiple withdrawal and/or the banknote jam, that is to say the banknotes from the incorrect withdrawal, are taken to the reject cassette and posted accordingly through the reject counter of the money cassettes from which the individual banknotes were removed.

In the context of this application, the term money cassette is understood to mean a physical money cassette in which banknotes can actually be received. The virtual auxiliary cassette, on the other hand, is a purely logical construct within the control unit by which stock control is ensured even with partial cassette exchanges. In the case of the money cassettes, they can be both money cassettes with a receiving area in which banknotes are received in stacked form and money cassettes with a drum module on which the banknotes are received, stored between two foil tapes spooled on a winding drum.

The stock counter and/or the reject counter for the money cassette can be stored in a memory element of the money cassette and/or in a memory element of the control unit. Storage in the memory element of the money cassette has the advantage that, when the money cassette is removed, the current quantity of banknotes in the money cassette is transferred by way of this memory element so that when the money cassette is inserted into another device for handling banknotes, said device can easily read the current quantity from the memory element of the money cassette. Storing the stock counter and the reject counter in a memory element of the control unit, on the other hand, has the advantage that the values of the stock and reject counters for all the money cassettes housed in the device are stored centrally in the control unit and can thus be handled easily.

If another money cassette is inserted into the device after removing the money cassette, the control unit overwrites the value of the stock counter of the money cassette that was removed with the value of the stock counter of the newly inserted money cassette and/or the value of the reject counter of the money cassette that was removed with the value of the reject counter of the newly inserted second money cassette in the memory element of the control unit. Thus, the values of the stock counter and the reject counter of the money cassette removed are no longer available so that if the reject cassette is not exchanged its quantity could no longer be determined if the value of the reject counter of the money cassette removed had not previously been added to the stock counter of the virtual auxiliary cassette. This overwriting of the values of the money cassette removed with the values of the new money cassette is unavoidable, specifically because of rigidly prescribed software structures that cannot readily be modified because of the standards in general use.

In one advantageous embodiment several money cassettes are housed in the device, whereby the current stock counter of each money cassette and/or the current reject counter are stored in a memory element of the money cassette and/or a memory element of the control unit. The device specifically has several receiving areas to receive one money cassette each. One stock counter and one reject counter is assigned explicitly to each receiving area in the control unit, wherein the respective stock counter has the value of the stock counter of the money cassette housed in the specific receiving areas, and the reject counter has the value of the corresponding reject counter of the money cassette housed in the particular receiving area. When a money cassette is exchanged, the stock counter and the reject counter of the receiving area from which the money cassette was removed and into which the new money cassette was installed are overwritten with the values of the stock counter, or the reject counter, of the newly installed money cassette. Through the previous addition of the value of the reject counter of the money counter removed to the stock counter of the virtual auxiliary cassette it is ensured that, in spite of the overwriting of the values of the stock and reject counters, the quantity in the reject cassette can still be determined through the virtual auxiliary cassette together with the reject counters of all the other money cassettes.

It is further advantageous, following removal of a money cassette from one of the receiving areas no other money cassette is installed in this receiving area, if the control unit assigns the value 0 to the stock counter assigned to this receiving area and to the reject counter assigned to this receiving area so that in this case also the banknote quantity in the device can easily be determined by adding together all stock counters and all reject counters.

It is further advantageous if, when the reject cassette has been removed from the device, the control unit assigns the value 0 to the stock counter of the virtual auxiliary cassette. Specifically, the control unit assigns the value 0 to all reject counters of the money cassettes housed in the device. Through the removal of the reject cassette the banknotes contained in the reject cassette are necessarily removed at the same time so that by resetting the stock counter of the virtual auxiliary cassette and the reject counters of the money cassettes it is shown that no further banknotes are contained in a reject cassette. Specifically, the reject cassette removed is replaced with a new empty reject cassette which does not yet contain any banknotes when it is installed so that said cassette has a quantity of 0, which also corresponds to the sum of the values of all reject cassettes and of the stock counter of the auxiliary cassette.

It is further advantageous if the control unit totals the values of the stock counters of all money cassettes housed in the device, the values of the reject counters of all money cassettes housed in the device and the value of the virtual auxiliary cassette. In this way the total quantity of banknotes for the device can easily be determined. In a particularly preferred embodiment the values of the stock counters are multiplied by the denomination in the corresponding money cassette so that the resulting total quantity by adding up these products resulting from the multiplication corresponds to the total value of all banknotes contained.

It is further advantageous, when removing a money cassette from the device, if not only the value of the reject counter of the money cassette removed, that is not only the number of banknotes, is stored, but also the denomination that was contained in the money cassette removed. In this way not only the number of banknotes in the reject cassette can be determined but also the value of said banknotes.

The control unit does not increase the value of the stock counter of the virtual auxiliary cassette when banknotes are taken to the reject cassette so that the value of the stock counter of the virtual auxiliary cassette remains unchanged in spite of the addition of a banknote. The value of the stock counter of the virtual auxiliary cassette is only changed when one of the money cassettes is removed from the device. The result is that, as long as the money cassette remains in the device, stock monitoring of banknotes in the device can take place in the same manner as with devices in which no virtual auxiliary cassette is configured in the control unit.

In particular, no separate stock counter is assigned to the reject cassette. Specifically, because of the Extension for Financial Service (XFS) applications used and/or the Java Extension for Financial Services (JXFS) applications used, the applications stored in the control unit are configured in such a way that only the money cassette in which banknotes can be deposited and withdrawn have stock and reject counters. However, in order to be able to determine the banknote quantity in the device in total, a reject counter is assigned to each money cassette in addition to the stock counter, as described previously. The result of providing the virtual auxiliary counter along with the stock counter is that, in spite of the lack of a stock counter for the reject cassette, the banknote quantity in the device can be determined as before, even when a money cassette is removed.

A dataset of a predetermined structure is stored in the control unit for each money cassette housed in the device. It is advantageous if a dataset is likewise stored in the control unit for the virtual auxiliary cassette which has this same predetermined structure. The dataset contains in particular the stock counter and the reject counter, respectively, for the money cassette installed. Thus, the virtual auxiliary cassette also has a reject counter, wherein said reject counter preferably has the value 0 and is left unchanged at this value 0.

In an alternative embodiment a predetermined dataset of a predetermined structure can be assigned to each of the receiving areas instead of the money cassettes.

It is particularly advantageous if the control unit treats the virtual auxiliary cassette as a physical money cassette in terms of data processing. Specifically, the same applications are used for changing the value of the stock counter of the virtual auxiliary cassette as when banknotes are deposited to or withdrawn from the physical money cassettes.

The device includes in particular at least one sensor with the aid of which the removal of a money cassette can be detected. If the removal is detected with the aid of this sensor, the value of the stock counter for the auxiliary cassette specifically is thereupon increased by the value of the reject counter for this money cassette.

An additional aspect of the invention relates to a method for operating a device for handling banknotes in which banknotes can be deposited and withdrawn with the aid of an input and output unit. At least one money cassette for holding banknotes, a reject cassette to receive banknotes to be retained and a stock counter are used, wherein the stock counter indicates the current holdings of the money cassettes in banknotes. When a banknote is removed from the money cassette, the value of the stock counter is decreased by the value 1, when a banknote is taken to the money cassette it is increased by the value 1. When an incorrect withdrawal occurs after at least one banknote is removed from the money cassette, the banknote, or the banknotes, from the incorrect withdrawal are transported to the reject cassette. A reject counter specific to the money cassette, and explicitly assigned to said cassette that indicates the total number of banknotes removed from this money cassette and taken to the reject cassette, is thereupon increased by the number of banknotes transported to the reject cassette because of this incorrect withdrawal. A virtual auxiliary cassette to which a stock counter is similarly explicitly assigned is set up in the software for the control unit, wherein, when the money cassette is removed from the device, the value of the stock counter of the virtual auxiliary cassette is increased by the value of the reject counter for the money cassette that was removed.

BRIEF DESCRIPTION OF THE DRAWINGS

The drawings described herein are for illustrative purposes only of selected embodiments and not all possible implementations, and are not intended to limit the scope of the present disclosure.

Additional features and advantageous of the invention can be seen from the following description which explains the invention in greater detail using embodiments in conjunction with the appended Figures.

FIG. 4 shows a schematic representation of stock monitoring before a double withdrawal occurs;

FIG. 5 shows a schematic representation of stock monitoring after a double withdrawal has occurred; and FIG. 6 shows a schematic representation of stock monitoring after the removal of a money cassette from the device from FIG. 1.

Corresponding reference numerals indicate corresponding parts throughout the several views of the drawings.

DETAILED DESCRIPTION OF THE PREFERRED EMBODIMENTS

Example embodiments will now be described more fully with reference to the accompanying drawings.

Figure 1:
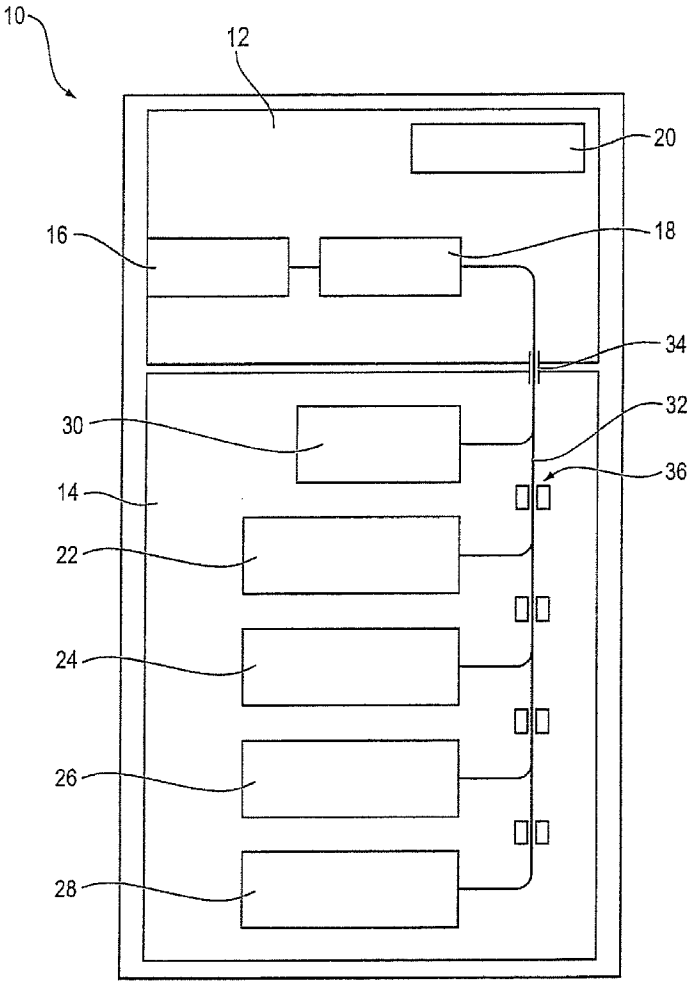
FIG. 1 shows a schematic representation of a device for handling banknotes.

A schematic representation of a device for handling banknotes, configured as an automated cash register system, is shown in FIG. 1. Alternatively, the device 10 can also be an automated teller machine and/or an automated teller safe.

The device 10 includes a head module 12 and a safe 14. An input and output unit 16 is located in the head module 12 by way of which banknotes can be inserted into the device 10 and banknotes can be dispensed from the device 10. In an alternative embodiment two separate units can be provided, one of which is used exclusively to deposit banknotes and the other exclusively to dispense banknotes.

A sensor unit 18 and a control unit 20 are also located in the head module. With the aid of the sensor unit 18, for example, the denomination of the banknotes deposited by way of the input and output unit 16 can be determined. In addition, with the aid of the sensor unit 18, the authenticity of the banknotes deposited can also be determined.

Four money cassettes 22 to 28 and a reject cassette 30 are located in the safe 14. Banknotes that are also intended for a withdrawal are received in the money cassettes 22 to 28, whereas those banknotes that are not intended for a withdrawal are received in the reject cassette 30. Specifically, the banknotes from a double or multiple withdrawal and/or from a banknote jam that has occurred are received in the reject cassette 30. This ensures that the banknotes from a double withdrawal, multiple withdrawal or banknote jam are not paid out to a person operating the device 10, and thus ensures that the correct sum of money is disbursed to the operator.

In alternative embodiment of the invention more than or fewer than four money cassettes 22 to 28 may be provided. Specifically, seven money cassettes 22 to 28 can be provided so that unmixed storage of all denominations of the Euro currency set is possible. If fewer than seven money cassettes 22 to 28 are provided, the banknotes are preferably stored unmixed in one part of said money cassettes 22 to 28, and in at least one of the money cassettes 22 to 28 the banknotes are kept in mixed storage. Unmixed storage is understood to mean that only banknotes of precisely one denomination are accepted in a money cassette 22 to 28, whereas with mixed storage banknotes of at least two different denominations are accepted in a money cassette 22 to 28. In the embodiment shown in FIG. 1, 5-euro banknotes are stored unmixed in the first money cassette 22, in the second money cassette 24 10-euro banknotes, and 20-euro banknotes in the third money cassette 26. The banknotes can be transported with the help of a transport unit, not shown, between the input and output unit 16 and the money cassettes 22 to 28 and the reject cassette 30 along a transport path 32. A transfer slot 34 is specifically formed here through which the banknotes can be transferred between the head module 12 and the safe 14. Several sensors are disposed along the transport path 32, one of which is identified as an example with the reference numeral 36. The occurrence of a banknote jam on the transport path 32 can be determined with the aid of these sensors. The sensors 36 specifically include a light curtain in each case. The sensors 36 can be thickness sensors for example, with the aid of which the thickness of the banknotes being transported past them can be determined so that double withdrawals, multiple withdrawals, slips and banknote jams can easily be detected. Banknote jams of this kind can occur while disbursing banknotes and while depositing banknotes. In the case of a banknote disbursal, banknote jams occur in particular when two banknotes are unintentionally pulled from one of the money cassettes 22 to 28 and thus a double or multiple withdrawal occurs. The occurrence of a double withdrawal, multiple withdrawal and/or banknote jam when disbursing banknotes is therefore also described as an incorrect withdrawal.

Figure 2:
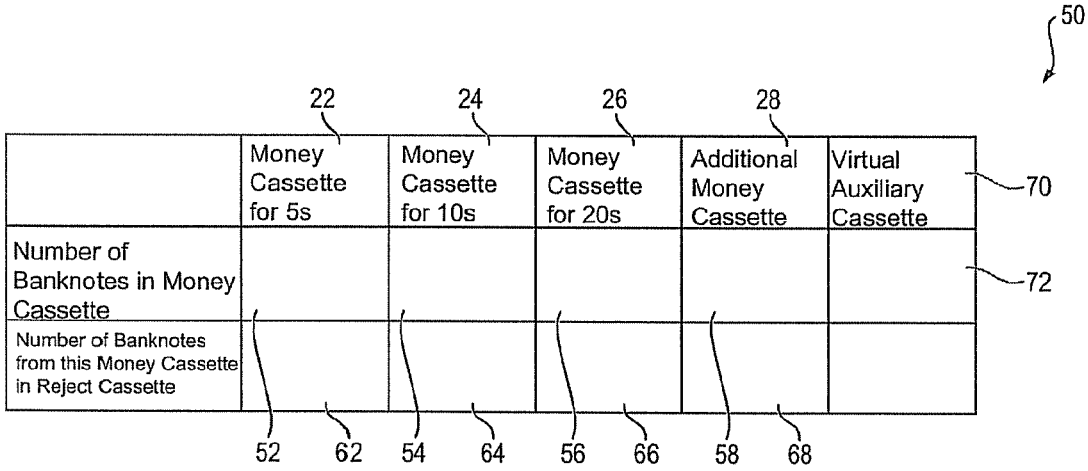
FIG. 2 shows a schematic representation of stock monitoring for monitoring the quantity of banknotes in the device from FIG. 1.

A schematic representation of stock control 50 in the device 10 from FIG. 1 is shown in FIG. 2. For this a stock counter 52 to 58 and a reject counter 62 to 68 is explicitly assigned to each money cassette 22 to 28. The stock counters 52 to 58 indicate respectively the current quantity of banknotes in the money cassettes 22 to 28. When there is a regular withdrawal of banknotes, the stock counters 52 to 58 are reduced by the control unit 20 in each case by the number of banknotes removed from the appropriate money cassette 22 to 28 at the time of withdrawal. Conversely, during a deposit of banknotes, the value of the appropriate stock counters 52 to 58 is increased in each case by the number of banknotes taken to the respective money cassette 22 to 28 for this deposit.

If a banknote jam or a double or multiple withdrawal occurs during the disbursement that is detected by one of the sensors 36, the banknotes from this incorrect withdrawal are transported to the reject cassette 30. In addition, the value of the reject counter 62 to 68 of the money cassettes 22 to 28 from which the banknotes of the banknote jam were removed is increased by the number of banknotes taken from the respective money cassette 22 to 28 and taken to the reject cassette 30. In this way, the particular reject counter 62 to 68 indicates the number of banknotes that were removed from the assigned money cassette 22 to 28 and taken to the reject cassette 30 instead of to the input and output unit 16.

As a result of the previously described assignment of a stock counter 52 to 58 and a reject counter 62 to 68 to each money cassette 22 to 28, the holdings of the device 10 can be determined easily at any time by totaling the values of the stock counters 52 to 58 and the reject counters 62 to 68. In particular, the individual stock counters 52 to 58 and reject counters 62 to 68 can be multiplied by the denomination of the corresponding money cassette 22 to 28 so that the value of the banknotes in the device 10 can easily be determined.

The reject cassette in particular does not include either a stock counter or a reject counter.

The table format selected in FIG. 2 to represent the stock counters 52 to 58 and the reject counters 62 to 68 in stock control 50 is chosen solely as a purely illustrative example of a comprehensible, compact representation and does not necessarily mean that storing the values from the stock counters 52 to 58 and the reject counters 62 to 68 also has to be carried out in table format in the control unit 20. The values from the stock counters 52 to 58 and reject counters 62 to 68 are preferably stored in a memory element of the control unit 20. In addition, or as an alternative, the values can also be stored in memory elements of the respective money cassette 22 to 28.

In addition, program data for at least one program to control the device 10 and the money cassettes 22 to 28 and the reject cassette 30 are stored in the control unit 20. Preferably a deposit application, a disbursement application and a reject application are stored in the control unit 20, wherein the deposit application is run when banknotes are deposited, and as the deposit application is being run, the stock counters of the respective money cassettes 22 to 28 are increased by the corresponding number of newly received banknotes. The disbursement application is run specifically by the control unit when banknotes are disbursed, wherein as the disbursement application is being run, the stock counters 52 to 58 of the money cassettes 22 to 28, as previously described, are decreased by the number of banknotes removed. The reject counter is then run accordingly if an incorrect withdrawal has occurred during the disbursement. When the reject application is run, the reject counters 62 to 68 of the respective money cassettes 22 to 28 are increased correspondingly by the number of banknotes removed from the respective money cassettes 22 to 28 and taken to the reject cassette 30.

The aforementioned applications are configured specifically as an Extension for Financial Services (FXS) application. As an alternative, the applications can also be configured as a Java Extension for Financial Services (JFXS). XFS and JXFS are the two well-established programming interfaces that are used for self-service devices. The posting of banknotes at the time of deposit, disbursement and the occurrence of an incorrect withdrawal at the time of disbursement described previously is determined by historical developments in programming using XFS or JXFS and cannot be readily modified because of the general use of these two standards.

In addition, stock monitoring 50 includes a virtual auxiliary cassette 70 to which a stock counter 72 is also assigned. A physical money cassette, like the money cassettes 22 to 28, is not directly assigned to this virtual auxiliary cassette 70. The virtual auxiliary cassette 70 serves rather, in the case of the existing applications described previously and software structures of the device 10, to determine the quantity of banknotes in the device 10 easily and free of errors, even with a partial exchange of cassettes, i.e. when not all the money cassettes 22 to 28 and the reject cassette 30 are exchanged.

No separate stock counter is assigned to the reject cassette 30 because of rigidly prescribed structures and applications in the control unit 20, specifically the XFS and JXFS standards used. As described previously, the quantity in the reject cassette 30 is determined by totaling the reject counters 62 to 68 of the individual money cassettes 22 to 28. As long as none of the money cassettes 22 to 28 has been removed, and thus the reject counters 62 to 68 of all the money cassettes 22 to 28 are known to the control unit 20, the quantity in the reject cassette 30 can be determined easily in this way at any time without difficulty. If a complete exchange of all money cassettes 22 to 28 and the reject cassette 30 is made, the quantity in the reject cassette 30 and thus the quantity in the device 10 can be determined in this way as before even after a new reject cassette 30 and new money cassettes 22 to 28 are installed.

The problem with this known method is, however, that a partial cassette exchange is not readily possible. If only one of the money cassettes 22 to 28, or several of the money cassettes 22 to 28, but not the reject cassette 30 are removed, the values of the stock counters 52 to 58 and of the reject counters 62 to 68 for these money cassettes are "lost" when the money cassettes 22 to 28 are removed, meaning that the control unit 20 can no longer use the values from the stock counters 52 to 58 and from the reject counters 62 to 68 to determine the quantity in the device 10. Specifically, when new money cassettes 22 to 28 are installed, the values from the stock counters 52 to 58 and the reject counters 62 to 68 of the money cassettes removed 22 to 28 are overwritten by the corresponding values from the counters of the newly installed money cassettes 22 to 28.

In order to be able to determine the quantity of banknotes in the reject cassette 30, and thus also in the device 10 even after a partial cassette exchange, the value of the reject counter 62 to 68 from this money cassette 22 to 28 is added to the value of the stock counter 72 of the virtual auxiliary cassette 70 when one of the money cassettes 22 to 28 is removed. Thus, this value is not lost when the money cassette 22 to 28 is removed from the device 10 so that if, as before, all stock counters 52 to 58, 70 and all reject counters 62 to 68 are totaled to determine the quantity in the device 10, the actual value of the banknotes received in the device 10 is the result. Thus, using the known software that is stored in the control unit 20, specifically with the aid of the prescribed applications, the quantity in the device 10 can easily be determined in spite of not exchanging the reject cassette 30. Consequently, a partial cassette exchange can be made without modifications to the software and the applications in the device 10. In particular, receiving areas in which the money cassettes 22 to 28 are housed can remain empty, i.e. a money cassette 22 to 28 is removed but no new money cassette 22 to 28 is installed.

Figure 3:
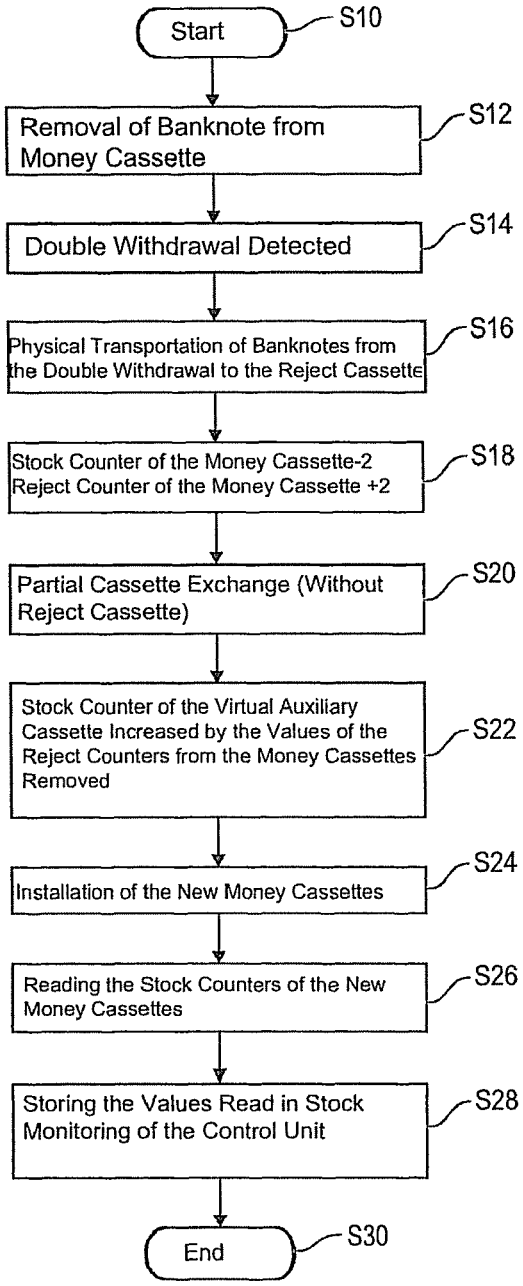
FIG. 3 shows a flow chart of a method for operating the device from FIG. 1.

In what follows, in conjunction with FIGS. 3 to 6, the method for controlling the device 10 during a partial cassette exchange is described using the example of a double withdrawal. A schematic representation of stock monitoring 50 before the start of the method from FIG. 3 is shown in FIG. 4. In the first money cassette 22 there are K 5-euro banknotes, in the second money cassette 24 L 10-euro banknotes, in the third money cassette 26 M 20-euro banknotes, and in the fourth money cassette 28 N 50-euro banknotes. The reject counters 62 to 68 for all money cassettes 22 to 28 have the value 0, meaning that at this time no incorrect withdrawal has occurred and no banknotes have yet been transported to the reject cassette 30. The stock counter 72 for the virtual auxiliary cassette also has the value 0, meaning that since the installation of the reject cassette 30 no money cassette 22 to 28 has been removed from which banknotes were previously transported to the reject cassette 30.

After the process has been started in step S10, a banknote is removed from the third money cassette 26 in step S12. After a double withdrawal has been detected in step S14 with the aid of sensor 36 at the time the banknote was removed, i.e. that two 20-euro banknotes were removed unintentionally from the third money cassette 26, said banknotes from the double withdrawal are transported physically in step S16 to the reject cassette 30.

Next, the value of the stock counter 56 for the third money cassette 26 is reduced by the value 2 because two banknotes were removed from the third money cassette 26 on account of the double withdrawal. Accordingly the stock counter 56, as can be seen from FIG. 5, has the value M−2. Similarly, the value of the reject counter 66 for the third money cassette 26 is increased in step S18 by the value 2 because two bank notes that were previously removed from the third money cassette 26 as a result of the double withdrawal were taken to the reject cassette 30. FIG. 5 thus shows the schematic representation of stock monitoring 50 after the double withdrawal occurred.

In step S20 a partial cassette exchange is made. In the embodiment shown, the first money cassette 22 and the third money cassette 26 are removed. The reject cassette 30 remains in the device 10.

In step S22 the value of the stock counter 72 for the virtual auxiliary cassette 70 is increased by the values of the reject counters 52, 56 from the money cassettes removed 22, 26. Because, in the embodiment shown, the reject counter 62 from the first money cassette 22 has the value 0 and the reject counter 66 from the third money cassette 26 has the value 2, the stock counter 72 for the virtual auxiliary cassette 70 is increased overall by the value 2. Thus, the stock counter 72 for the virtual auxiliary cassette 70 has the value +2, because it had the value 0 before the two money cassettes 22, 26 were removed.

Next, in step S24, two new money cassettes 74, 75 are installed into those receiving areas of the device 10 in which the money cassettes 22, 26 were previously installed.

From the memory elements of the new money cassettes 74, 76, the control unit 20 reads in step S26 the values of the stock counters 78, 80 of the new money cassettes 74, 76 and stores these read values in stock monitoring 50 of the control unit 20. In the embodiment, money cassette 74 has a quantity of S and money cassette 76 has a quantity of T. The procedure is subsequently concluded in step S30.

Thus, after the conclusion of the procedure from FIG. 3, stock monitoring 50 shown in FIG. 6 is the result, in which the stock counter 72 of the virtual auxiliary cassette 70 has the value +2, whereas all the reject counters 64, 68, 84, 86 of the money cassettes 24, 28, 74, 76 have the value 0.

If no new money cassettes 74, 76 are installed in step S24, the stock counters 52, 56 and reject counters 62, 66 assigned to the receiving areas from which the money cassettes 22, 26 were removed are assigned the value 0. In this way, even when the receiving areas are left empty, the current quantity of banknotes in the device 10 can be determined, as described previously for the complete stocking of the device 10 with banknotes. In addition, as an alternative differing from the previously described embodiment, a money cassette 74, 76 of a differing denomination can installed in the appropriate receiving areas.

In an alternative embodiment, a reject counter can also be assigned to the virtual auxiliary cassette 70 for stock monitoring 50. This has the advantage that the virtual auxiliary cassette 70 has the same data structure as the physical money cassettes 22 to 28 and can thus be run using the same applications in the control unit 20. The reject counter for the virtual auxiliary cassette then has the value 0, where this value remains unchanged at 0, independently of which banknotes are taken to the reject cassette 30 and how the value of the quantity counter 72 of the virtual auxiliary counter 70 is changed.

If the reject cassette 30 is removed from the device 10, the stock counter 72 of the virtual auxiliary cassette 70 is reset to 0, because all the banknotes that were represented by said counter were removed along with the reject cassette 30.

When banknotes are taken to the reject cassette 30 in step S16, both the value of the stock counter 72 and the value of a possible reject counter for the virtual auxiliary cassette 70 remain unchanged. The stock counter 72 of the virtual auxiliary cassette 70 does not, therefore, correspond to a stock counter in the reject cassette 30 that indicates at all times the current quantity in the reject cassette 30, that is to say the number of bank notes received therein.

The foregoing description of the embodiments has been provided for purposes of illustration and description. It is not intended to be exhaustive or to limit the invention. Individual elements or features of a particular embodiment are generally not limited to that particular embodiment, but, where applicable, are interchangeable and can be used in a selected embodiment, even if not specifically shown or described. The same may also be varied in many ways. Such variations are not to be regarded as a departure from the invention, and all such modifications are intended to be included within the scope of the invention.

What is claimed is:

1. A device for handling banknotes, having an input and output unit to deposit and disburse banknotes, said device comprising:

a control unit, at least one money cassette for storing banknotes, a reject cassette to receive banknotes to be retained, and a transport unit to transport the banknotes between the input and output unit, the money cassette and the reject cassette, wherein a stock counter is provided that indicates the current quantity of banknotes for the money cassette, wherein when a banknote is removed from the money cassette the control unit reduces the value of the stock counter by the value one and when a banknote is brought to the money cassette said control unit increases the value of the stock counter by the value one, wherein when an incorrect withdrawal occurs after at least one banknote is removed from the money cassette, the control unit activates the transport unit in such manner that said transport unit transports the banknote, or banknotes, from the incorrect withdrawal to the reject cassette, and wherein a money cassette-specific reject counter, explicitly assigned to the money cassette, is provided that indicates the total number of banknotes removed from this money cassette and taken to the reject cassette, and wherein the control unit increases the value of this reject counter by the number of banknotes transported to the reject cassette by reason of the incorrect withdrawal, wherein a virtual auxiliary cassette to which a stock counter is assigned is located in software of the control unit, and that the control unit increases the value of the stock counter of the virtual auxiliary cassette by the value of the reject counter of the money cassette when the money cassette is removed from the device.

2. The device according to claim 1, wherein the stock counter and/or the reject counter of the money cassette are/is stored in a memory element of the money cassette.

3. The device according to claim 1, wherein the stock counter and/or the reject counter of the money cassette are/is stored in a memory element of the control unit of the device.

4. The device according to claim 3, wherein after the removal of the money cassette a second money cassette is installed in the device and wherein the control unit overwrites the value of the stock counter of the money cassette removed with the value of the stock counter of the newly installed second money cassette and/or overwrites the value of the reject counter of the money cassette removed with the value of the reject counter of the newly installed second money cassette.

5. The device according to claim 1, wherein several money cassettes are housed in the device, and wherein the current respective stock counter from each money cassette and the current respective reject counter are stored.

6. The device according to claim 1, wherein the device includes several receiving areas to house one money cassette, and wherein a stock counter and a reject counter explicitly assigned to each receiving area are stored in the control unit, wherein the respective stock counter has the value of the stock counter of the money cassette housed in the respective receiving area and of the reject counter of the money cassette housed in the respective receiving area.

7. The device according to claim 6, wherein, after removing a money cassette from one of the receiving areas, no second money cassette is installed in this receiving area, and wherein the control unit assigns the value zero respectively to the stock counter allocated to this receiving area and to the reject counter.

8. The device according to claim 1, wherein the control unit assigns the value zero to the stock counter of the virtual auxiliary cassette when the reject cassette is removed from the device.

9. The device according to claim 1, wherein the control unit totals the values of the stock counters for all the money cassettes housed, the values of the reject counters for all the money cassettes housed and the value of the stock counter for the virtual auxiliary cassette.

10. The device according to claim 1, wherein the value of the stock counter of the virtual auxiliary cassette remains unchanged when banknotes are taken to the reject cassette.

11. The device according to claim 1, wherein a stock counter is not assigned to the reject cassette.

12. The device according to claim 1, wherein a dataset of a predetermined structure is stored in the control unit for each money cassette housed in the device, and wherein a dataset with the same predetermined structure is stored in the control unit for the virtual auxiliary cassette.

13. The device according to claim 1, wherein the control unit treats the virtual auxiliary cassette as a physical money cassette.

14. A method for operating a device for handling banknotes, in which with the aid of an input and output unit banknotes are disbursed and deposited, comprising:

providing at least one money cassette that is used to store banknotes, providing a reject cassette that is used to receive banknotes that are to be retained, providing a stock counter that indicates the current quantity of banknotes in the money cassette, wherein when a banknote is removed from the money cassette the value of the stock counter is reduced by the value one, and wherein when a banknote is taken to the money cassette the value of the stock counter is increased by the value one, wherein when an incorrect withdrawal occurs after removing at least one banknote from the money cassette, the banknote, or banknotes, from the incorrect withdrawal are taken to the reject cassette, wherein a money cassette-specific reject counter, explicitly assigned to the money cassette, is used, which indicates the total number of banknotes removed from this money cassette and taken to the reject cassette, and where the value of this reject counter is increased by the number of banknotes transported to the reject cassette by reason of this incorrect withdrawal, wherein a virtual auxiliary cassette, to which a stock counter is assigned, is set up in software of the control unit, and in that, when the money cassette is removed from the device, the value of the stock counter in the virtual auxiliary cassette is increased by the value of the reject counter of the money cassette.

* * * * *